United States Patent [19]

Sawada et al.

[11] 4,292,984

[45] Oct. 6, 1981

[54] FILTER FOR CIGARETTE SMOKE

[75] Inventors: Hideo Sawada, Osaka; Koji Shinohara, Kawachinagano; Makoto Shiga, Sakai, all of Japan

[73] Assignee: Daicel Ltd., Osaka, Japan

[21] Appl. No.: 32,428

[22] Filed: Apr. 23, 1979

[30] Foreign Application Priority Data

Apr. 22, 1978 [JP] Japan ..... 53/48245

[51] Int. Cl.[3] ..... A24D 3/02; A24D 3/04

[52] U.S. Cl. ..... 131/345; 131/340; 131/342; 131/344

[58] Field of Search ..... 131/268, 10.7, 267, 131/269

[56] References Cited

U.S. PATENT DOCUMENTS

| | | | |
|---|---|---|---|
| 3,110,642 | 11/1963 | Harrington et al. | 131/269 |
| 3,144,025 | 8/1964 | Erlich | 131/269 |
| 3,148,101 | 9/1964 | Allman Jr. et al. | 131/268 |
| 3,543,769 | 12/1970 | Arthur et al. | 131/268 |
| 4,197,863 | 4/1980 | Clayton et al. | 131/10.7 |

*Primary Examiner*—V. Millin

*Attorney, Agent, or Firm*—Sughrue, Mion, Zinn, Macpeak & Seas

[57] ABSTRACT

A cigarette filter composed of a bundle of cellulose acetate filaments having at least two different filament denier sizes randomly distributed in the direction perpendicular to the longitudinal axis of said filter.

5 Claims, No Drawings

FILTER FOR CIGARETTE SMOKE

BACKGROUND OF THE INVENTION

1. Field of the Invention

This invention relates to a cigarette filter composed of a bundle of cellulose acetate filaments. More specifically, this invention relates to a cigarette filter composed of a bundle of cellulose acetate filaments having at least two different filament denier sizes, said filament bundle having a number average filament denier size of not more than about 4 denier, preferably not more than about 3.5 denier, the ratio of its weight average filament denier to its number average filament denier size being at least about 1.03, preferably at least about 1.05. The term "denier" as used herein is defined as the weight in grams of a filament 9000 meters long.

2. Description of the Prior Art

Present-day, cigarette filters are composed mainly of a bundle of cellulose acetate filaments and generally the filament bundle is an assembly of filaments having a single cross-sectional shape and denier. The recent tendency is toward filters having an increased tar filtration efficiency as a result of considerations of the health of smokers and changes in the taste of smokers. The increase of the tar filtration efficiency of filters can be achieved by using filaments having a fine denier size because a relatively large filament surface area can be obtained. However, when the denier size of filaments is decreased while keeping the total denier of the filament bundle unchanged, the pressure drop across the filament bundle increases with the increase in the filtration efficiency and a large amount of suction is required to smoke the cigarette. If the filling density is reduced so as to decrease the pressure drop, the filament bundle does not have sufficient hardness, and is not adaptable for manufacturing by a machine which molds the filter rod and connects it to the cigarette.

Some attempts have been made to overcome these difficulties and to obtain filters having a high filtration efficiency and a low pressure drop. For example, it has been suggested to retain hardness and filtration efficiency and reduce pressure drop by molding a filament bundle composed of filaments having a fine denier (for example, Japanese patent applications (OPI) Nos. 7799/72 and 7500/74 (The term "OPI" as used herein refers to a "published unexamined Japanese patent application.")). However, a special device is required to produce the molded filters and continuous production of such filters is difficult. Moreover, it is difficult to perform production economically.

It has also been proposed to reduce pressure drop by providing vents in the filter wrapping paper, thus permitting air flow (for example, Japanese patent applications (OPI) Nos. 79099/77 and 114100/77). However, the balance of the components making up the tobacco smoke changes which tends to impair the flavor and smoking taste of the cigarettes.

Cigarette filters composed of a group of fibers having different filament denier sizes have also been suggested. For example, a filter has been suggested in which fibers having a large filament denier size are present near the central axis of the filter and fibers having a fine filament denier size are present in the peripheral portion of the filter and the fibers are aligned concentrically (for example, Japanese patent application (OPI) No. 79098/77). A filter having a high filtration efficiency and a good smoking taste is supposed to be obtained by allowing smoke having a low filtration efficiency to pass through the central part of the filter and smoke having a high filtration efficiency to pass through the peripheral portion. However, the manufacturing process for this filter is complex, and the filter is difficult to produce by an ordinary filter making machine. Thus, a special manufacturing apparatus is required. Furthermore, because fibers of a fine denier size are aligned in the peripheral portion of the filter, its hardness tends to be insufficient when the degree of filling is such as to give a suitable pressure drop. It is difficult to produce such a filter industrially with good efficiency.

It has also been suggested to provide a filter of nonwoven cloth by aligning fibers of different filament denier sizes randomly and molding them into a web (Japanese patent application (OPI) No. 133499/76). This technique is quite different from the process for manufacturing a filter composed of aligned filament bundles, and it is difficult to utilize this technique based on presently established techniques for producing beautiful filters at high speeds.

SUMMARY OF THE INVENTION

It is a principal object of the present invention to provide a novel cigarette filter composed of a bundle of cellulose acetate filaments having an increased tar filtration efficiency without increasing pressure drop.

It is another object of the present invention to provide a cigarette filter having a hardness such that it can be manufactured and attached to a cigarette without using a special apparatus.

It is still another object of the present invention to provide a cigarette filter which does not impair the flavor and smoking taste of the cigarette.

The cigarette filter of this invention has the following characteristic features.

(1) it is a fibrous assembly composed of aligned bundles of cellulose acetate filaments.

(2) The filament assembly has a distribution of filament denier sizes and is composed substantially of filaments having at least two different filament denier sizes, the filaments being randomly distributed in a direction perpendicular to (across) the longitudinal axis of the filter.

(3) The constituent filaments have a number average filament denier size of not more than about 4 denier, preferably not more than about 3.5 denier.

(4) The distribution of the filament denier sizes is such that the ratio of the weight average filament denier size to the number average of the filament denier size is at least about 1.03, preferably at least about 1.05.

DETAILED DESCRIPTION OF THE INVENTION

As stated above, in the filter of this invention, filaments having two or more different filament denier sizes are aligned parallel to each other along the longitudinal axis of the filter, but the distribution of the filament denier sizes is random in a direction perpendicular to the axis. Filament bundles of this structure can be obtained, for example, in the following manner.

A plurality of spinnerets for obtaining filament tows having a certain filament denier size and an approximately equal number of spinnerets for obtaining filament tows having a different filament denier size are provided. Filaments are produced through these spinnerets, and the filament tows are bundled so that they overlap one another alternately to form one tow. The tow is conducted to a crimper to crimp it. Then, under low tension, a stream of air is applied to the crimped tow to separate the tow into the individual filaments, and the tow is subjected to filter making machine while again bundling the filaments. The crimper and the filter making machine may be the same as those which have been used in the art in the past.

In the filter composed of filaments having two or more different filament denier sizes randomly aligned, the filtration efficiency is determined substantially by the number average filament denier of the filaments. To obtain a filter having a high tar filtration efficiency, it is essential that the number average filament denier size of the filaments should be not more than about 4, preferably not more than about 3.5. Here it is noted that from a practical standpoint technical difficulties are encountered producing a filament finer than 1 denier by dry spinning. On the other hand, the inclusion of fibers having a denier size above a certain limit in a filter rod is necessary to obtain suitable hardness of the rod which affects the processability and the dimensional stability of the product. The inclusion of these large denier fibers (up to about 10 denier) has the effect of reducing the pressure drop of the filter as a whole and maintaining the ease of smoking. The number of such large denier filaments can be made comparatively small when the filament denier size is comparatively large and somewhat larger when the filament denier size is comparatively small. The filament denier size distribution and the fiber mixing ratio can be expressed in terms of the ratio of the weight average filament denier size to the number average filament denier size. It is essential in this invention to adjust this ratio to at least about 1.03, preferably to at least about 1.05. Usually, the weight average to number average ratio will not exceed about 3.0.

The effects of this invention can be more fully exhibited when the difference in filament denier size between filaments having a fine denier size and filaments having a large denier size in the filter is larger and the difference should be at least about 3 denier. Practically speaking the maximum difference in denier sizes among the filaments will be about 9 denier since filaments finer than 1 denier are presently difficult to make and the filtration efficiency is not as good when filaments larger than about 10 denier are used.

The filter of this invention can be produced without requiring any special apparatus. The filter and filter-equipped cigarettes can be produced by using known plasticizers as described in U.S. Pat. No. 3,297,512 such as triacetin, triethylene glycol diacetate or 1,3-butanediol diacetate in substantially the same tow processing machine and filter making machine as in the prior art. The cigarette filter of this invention has a high filtration efficiency and a moderately low pressure drop, and cigarettes with this filter are easy to smoke. The smoke particles are fine and the taste is mellow.

The cigarette filter according to this invention which is composed of a tow of cellulose acetate filaments having different filament denier sizes has the following general advantages over the cigarette filter composed of the conventional tow of cellulose acetate;

(1) With the same pressure drop, the cigarette fillter of this invention provides higher filtration performance, and this advantage is the more noticeable as the ratio of weight average filament denier to number average filament denier increases;

(2) Mixing filaments of fine denier with those of large denier provides a filter rod of desired hardness;

(3) The "capability curve" for the filter of this invention which is obtained by plotting pressure drop against net tow weight has a gentle slope, with a change in the net tow weight being accompanied by a small change in pressure drop, and this fact contributes to easy rod molding;

(4) The cigarette filter of this invention is economical because the plug can be produced with a small amount of filaments to provide the intended filtration performance.

The following Examples and Comparative Examples illustrate the present invention more specifically.

In the following examples, hardness, pressure drop, TPM (total particulate matter), tar filtration efficiency, nicotine filtration efficiency, the net tow weight, the number average filament denier and the weight average filament denier were measured by the following methods.

HARDNESS

A load of 300 g is exerted for 10 seconds on a horizontal filter rod placed through a disc having a diameter of 12 mm. The extent of the dent which results in the filter is measured and expressed in units of 0.1 mm to one decimal place as a significant figure. Smaller values indicate higher hardness and larger values indicate lower hardness. For processing in a high speed machine now in use, the hardness should not be more than 10.

PRESSURE DROP

A filter and a water column U-shaped tube gauge are connected in series to a vacuum pump. Air is sucked by the vacuum pump, and the gradation of the water column gauge is read when the air flow passing through the filter is 17.5 ml per second. The value obtained is defined as the pressure drop.

TPM AND TAR AND NICOTINE FILTRATION EFFICIENCIES

A cigarette with a filter is automatically smoked by an automatic cigarette smoking machine at a constant flow rate and fixed time type under the following conditions.

| | |
|---|---|
| Flow rate | 17.5 ml per second |
| Frequency of puff | 1 per minute |
| Time of smoking for each puff | 2 seconds (35 ml) |
| Burning length | 50 mm |

The total particulate matter in the smoke which passed though the filter is collected by a glass fiber filter pad (Cambridge Filter). The amounts of TPM and tar are determined by weighing and the amount of nicotine is determined by ultraviolet absorption. The amount of tar is obtained by subtracting the amount of moisture from TPM. The filtration efficiency is calculated in accordance with the following equation.

$$\text{Filtration efficiency (\%)} = \frac{\text{Quantity collected in the filter}}{\left(\begin{array}{c}\text{Quantity collected}\\ \text{on Cambridge filter}\end{array}\right) + \left(\begin{array}{c}\text{Quantity collected}\\ \text{in the filter}\end{array}\right)} \times 100$$

NET TOW WEIGHT

The wrapping paper is removed from a molded filter, and the fiber and plasticizer are extracted to remove the plasticizer by using benzene. The weight of the residue is measured and defined as the net tow weight.

FILAMENTS DENIER SIZE

Denier refers to the weight in grams of a filament having a length of 9000 meters. Since the filaments used in this invention are crimped filaments, a load corresponding to 4 g per monofilament is exerted to elongate the filament, and its weight is measured when it measures 9000 meters in length.

AVERAGE FILAMENT DENIER

The number average filament denier ($\bar{f}_n$) and the weight average filament denier ($\bar{f}_n$) are calculated in accordance with the following equations.

$$f_n = \frac{\Sigma n_i f_i}{\Sigma n_i}, \quad \bar{f}_w = \frac{\Sigma W_i f_i}{\Sigma W_i}$$

where $n_i$ is the number of filaments having a denier $f_i$; $W_i$ is the weight of filaments having a denier of $f_i$. Generally, $f_n > \bar{f}_w$ holds true, but in a filter composed of filaments having one specified denier size, $\bar{f}_n = \bar{f}_w$. With increasing difference between the different filament denier sizes, the value of $\bar{f}_w/\bar{f}_n$ becomes more than 1.

COMPARATIVE EXAMPLE 1

A cellulose acetate tow having a filament denier of 4 denier, a Y-shaped cross-sectional type and a total denier of 43,000 containing 25 crimps per 25 mm, was spread into individual filaments in an ordinary method. Triacetin, a plasticizer, was added to the filaments in an amount of 8% by weight based on the filaments, and a filter rod having a length of 102 mm and a circumference of 24.7 mm was molded from the filaments by a filter making machine. The rod had a net tow weight of 0.612 g, a pressure drop of 250 mm and a hardness of 9.4.

The rod was cut to a length of 17 mm, and attached to commercially available cigarettes equipped with filters ("HILITE," Cigarettes manufactured by Japan Tobacco and Salt Public Corporation) from which the filter tip portions had been removed. TPM, tar and nicotine filtration efficiencies were thus measured.

COMPARATIVE EXAMPLE 2

A filter rod having a length of 102 mm and a circumference of 24.7 mm was molded in the same way as in Comparative Example 1 using a tow of cellulose acetate filaments having a filament denier of 3.3, a Y-shaped cross-sectional type, and a total denier of 30,000 and containing 25 crimps per 25 mm. The rod had a net tow weight of 0.504 g, a pressure drop of 220 mm and a hardness of 12. The pressure drop was suitable, but the hardness was low. Thus, the filter rod was not suitable for connecting it to a cigarette by machine.

To obtain a rod of sufficient hardness, a tow having a total denier of 40,000 with a filament denier of 3.3 was molded into a rod. The resulting rod had a net tow weight of 0.580 g, a pressure drop of 280 mm, and a hardness of 10. This rod produced such a large pressure drop that it was difficult to smoke.

COMPARATIVE EXAMPLE 3

A rod having a length of 102 mm and a circumference of 24.7 mm was produced in the same way as in Comparative Example 1 using a tow of cellulose acetate filaments having a filament denier of 6, a regular cross-sectional type, and a total denier of 40,000 containing 25 crimps per 25 mm. The rod had a net tow weight of 0.890 g, a pressure drop of 220 mm, and a hardness of 7.3. While the pressure drop and hardness of the filter were comparable to the filter of Example 1 below, but the net tow weight was larger, resulting in a higher cost of production.

COMPARATIVE EXAMPLE 4

A rod was molded under the same conditions as in Comparative Example 1 using a tow of cellulose acetate filaments having a filament denier of 5, a Y-shaped cross-sectional type and a total denier of 43,000 and containing 25 crimps per 25 mm. The rod had a net tow weight of 0.615 g, a pressure drop of 240 mm, and a hardness of 9.0. In the same way as in Comparative Example 1, the rod was attached to "HILITE" cigarettes from which the filter tips had been removed, and TPM, tar and nicotine efficiencies were measured.

EXAMPLES 1 and 2

Cellulose acetate filaments having a filament denier of 1.9 and a Y-shaped cross-sectional type and containing 25 crimps per 25 mm and cellulose acetate filaments having a filament denier of 8 and a regular cross-sectional type and containing 25 crimps per 25 mm were mixed with each other in an amount of 50% by weight, and aligned parallel to each other to form a tow having a total denier of 43,000. The resulting tow had a number average filament denier of 3.07 and a weight average filament denier of 4.95 with the ratio of the weight average filament denier to the number average filament denier being 1.61.

Using the resulting mixed tow, a filter rod having a length of 102 mm and a circumference of 24.7 mm was molded by the same procedure as in Comparative Example 1. The rod had a net tow weight of 0.620 g, a pressure drop of 221 mm, and a hardness of 8.9.

The rod was cut to a length of 17 mm, and attached to commercially available "HILITE" cigarettes from which the filter tips had been removed and TPM, tar and nicotine filtration efficiencies were measured.

The same measurement was conducted using the rod cut to a length of 20 mm.

The results obtained in the above Examples and Comparative Examples are shown in Table 1.

TABLE 1

| Run | Filter tip Length (mm) | Filter tip Pressure drop (mm water) | Filter tip Net tow weight (g) | Pressure drop of the filter-equipped cigarette (mm water) | Filtration efficiencies (%) TPM | Tar | Nicotine |
|---|---|---|---|---|---|---|---|
| Example 1 | 17 | 40 | 0.103 | 100 | 46.3 | 37.4 | 31.1 |
| Example 2 | 20 | 48 | 0.122 | 120 | 49.2 | 39.1 | 32.4 |
| Comparative | 17 | 48 | 0.102 | 120 | 44.3 | 35.6 | 30.7 |

TABLE 1-continued

| Run | Filter tip Length (mm) | Pressure drop (mm water) | Net tow weight (g) | Pressure drop of the filter-equipped cigarette (mm water) | Filtration efficiencies (%) TPM | Tar | Nicotine |
|---|---|---|---|---|---|---|---|
| Example 1 | | | | | | | |
| Comparative Example 4 | 17 | 38 | 0.103 | 100 | 40.1 | 30.8 | 26.8 |

As shown by the Examples and Comparative Examples, when a tow of cellulose acetate filament having one denier size is used, the hardness of the filter must be increased either by increasing the net tow weight or by using a tow having a larger total denier size, and even if a filter having sufficient hardness is obtained by this procedure its pressure drop is too high. In contrast, the rods obtained in accordance with the present invention have sufficient hardness and pressure drop and the filtration efficiencies of these filters are better than those in the Comparative Examples.

EXAMPLE 3

Eighty-five percent by weight of a cellulose acetate tow having a filament denier of 1.5 and a Y-shaped cross-sectional type and containing 25 crimps per 25 mm was mixed with 15% by weight of a cellulose acetate tow having a denier of 9 and a regular cross-sectional type and containing 25 crimps per 25 mm, and aligned parallel to each other to form a tow having a total denier of 30,100. The resulting tow composed of filaments of different filament denier sizes had a number average filament denier (hereunder $\bar{f}_n$) of 1.74 and a weight average filament denier (hereunder $\bar{f}_w$) of 2.63, with the ratio of weight average filament denier to number average filament denier being 1.51. Using the resulting mixed tow, a filter rod having a length of 120 mm and a circumference of 24.7 mm was molded by the same procedure as in Comparative Example 1. The rod was filled with 0.512 g of tow and had pressure drop of 282 mm (water).

The rod was cut to a length of 20 mm and attached to a commercially available "HILITE" from which the filter tip had been removed, and its filtration efficiencies for TPM, tar and nicotine were measured. The results of the measurement are shown in Table 2 below.

COMPARATIVE EXAMPLE 5

The same rod as prepared in Comparative Example 1 was cut to a length of 20 mm and attached to a commercially available "HILITE" from which the filter tip had been removed, and its filtration efficiencies for TPM, tar and nicotine were measured. The results of the measurement are also shown in Table 2 below.

Comparison of Example 3 and Comparative Example 5 shows that the cigarette filter according to this invention composed of a tow having filaments of different filament denier sizes mixed together was characterized by economy of a smaller net tow weight for the same pressure drop plus higher filtration efficiencies for TPM, tar and nicotine.

EXAMPLE 4

A cellulose acetate tow having a filament denier of 1.8 and a Y-shaped cross-sectional type and containing 27 crimps per 25 mm and a cellulose acetate tow having a filament denier of 3.3 and a Y-shaped cross-sectional type and containing 27 crimps per 25 mm were mixed together each in an amount of 50% by weight, and aligned parallel to each other to form a tow having a total denier of 33,000. The resulting tow composed of filaments of different filament denier sizes had a number average filament denier ($\bar{f}_n$) of 2.33 and a weight average filament denier ($\bar{f}_w$) of 2.56, with the ratio of $\bar{f}_w$ to $\bar{f}_n$ being 1.10. Using the resulting mixed tow, a filter rod having a length of 120 mm and a circumference of 24.35 mm was molded by the same procedure as in Comparative Example 1.

The rod was filled with 0.858 g of tow, and had a pressure drop of 310 mm (water) and a hardness of 8. The rod was cut to a length of 20 mm and attached to a commercially available "HILITE" from which the filter tip had been removed, and its filtration efficiencies for TPM, tar and nicotine were measured. The results of the measurement are shown in Table 2 below.

COMPARATIVE EXAMPLE 6

A rod havig a length of 120 mm and a circumference of 24.35 mm was produced in the same way as in Comparative Example 1 using a tow of cellulose acetate filaments having a filament denier of 2.5, a Y-shaped cross-sectional type, and a total denier of 35,000, and contained 27 crimps per 25 mm. As shown in Table 2 below, the rod was filled with 0.587 g of tow, and had a pressure drop of 309 mm (water) and a hardness of 10.

Comparison between Example 4 and Comparative Example 6 shows that in spite of a large amount of net tow weight, the filter rod produced in Comparative Example 6 exhibited low filtration efficiencies and a hardness which was not high enough to provide sufficient mechanical suitability for connection to a cigarette. In contrast, the cigarette filter produced in Example 4 which was composed of tows of different filament denier sizes exhibited high filtration efficiencies, hardness and mechanical suitability for connection to a cigarette.

TABLE 2

| | Filter Tip Length (mm) | Pressure drop (mm water) | Net tow weight (g) | Pressure drop of filter-tipped cigarette (mm water) | Filtration efficiencies (%) TPM | Tar | Nicotine |
|---|---|---|---|---|---|---|---|
| Example 3 | 20 | 55 | 0.0853 | 125 | 56.3 | 46.4 | 41.7 |
| Example 4 | 20 | 59 | 0.0975 | 130 | 52.7 | 45.9 | 36.5 |
| Comparative Example 5 | 20 | 55 | 0.120 | 125 | 52.3 | 44.5 | 36.0 |
| Comparative Example 6 | 20 | 59 | 0.0978 | 130 | 52.1 | 45.0 | 35.5 |

While the invention has been described in detail and with reference to specific embodiments thereof, it will be apparent to one skilled in the art that various changes and modifications can be made therein without departing from the spirit and scope thereof.

What is claimed is:

1. A cigarette filter comprising a bundle of cellulose acetate filaments, each filament being substantially uniform in its denier size, said bundle being composed of a plurality of filaments having at least two different filament denier sizes, said filaments running parallel to the longitudinal axis of said filter and being randomly distributed in the direction perpendicular to the longitudinal axis of said filter and wherein said filaments having at least two different filament denier sizes have a number average filament denier of not more than about 4 denier, and wherein the ratio of the weight average filament denier to the number average filament denier size of the bundle is at least about 1.03.

2. The cigarette filter of claim 1, wherein said filaments have a number average filament denier of not more than about 3.5 denier.

3. The cigarette filter of claim 2, wherein the weight average to number average filament denier ratio is at least about 1.05.

4. The cigarette filter of claim 1, wherein the difference in denier sizes is at least about 3 denier.

5. The cigarette filter of claim 1, 2, 3 or 4 wherein the cellulose acetate filaments have been prepared by dry spinning.

* * * * *